US008999072B2

(12) United States Patent
Varrin, Jr. et al.

(10) Patent No.: US 8,999,072 B2
(45) Date of Patent: Apr. 7, 2015

(54) CHEMICAL CLEANING METHOD AND SYSTEM WITH STEAM INJECTION

(75) Inventors: Robert D. Varrin, Jr., Reston, VA (US); Michael J. Little, Ashburn, VA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 361 days.

(21) Appl. No.: 13/063,443

(22) PCT Filed: Dec. 3, 2009

(86) PCT No.: PCT/US2009/066652

§ 371 (c)(1),
(2), (4) Date: Aug. 26, 2011

(87) PCT Pub. No.: WO2010/065785

PCT Pub. Date: Jun. 10, 2010

(65) Prior Publication Data

US 2011/0303247 A1 Dec. 15, 2011

Related U.S. Application Data

(60) Provisional application No. 61/119,719, filed on Dec. 3, 2008.

(51) Int. Cl.
*B08B 3/00* (2006.01)
*B08B 9/00* (2006.01)
(Continued)

(52) U.S. Cl.
CPC ..... *F22B 37/002* (2013.01); *B08B 9/00* (2013.01); *C23G 5/00* (2013.01); *F22B 37/486* (2013.01);
(Continued)

(58) Field of Classification Search
None
See application file for complete search history.

(56) References Cited

U.S. PATENT DOCUMENTS 2,289,351 A 7/1942 Dixon et al.
3,084,076 A * 4/1963 Loucks et al. ..... 134/22.1
(Continued)

FOREIGN PATENT DOCUMENTS

DE 2824814.8 12/1978
DE 4039376.3 6/1991
(Continued)

OTHER PUBLICATIONS
English Machine Translation of JP 2005-087524 A.*
(Continued)

*Primary Examiner* — Nicole Blan
(74) *Attorney, Agent, or Firm* — Richard J. Coldren; Westinghouse Electric Company LLC

(57) ABSTRACT

Disclosed are methods and apparatus for cleaning heat exchangers and similar vessels by introducing chemical cleaning solutions and/or solvents while maintaining a target temperature range by direct steam injection into the cleaning solution. The steam may be injected directly into the heat exchanger or into a temporary side stream loop for recirculating the cleaning solution or admixed with fluids being injected to the heat exchanger. The disclosed methods are suitable for removing metallic oxides from a heat exchanger under chemically reducing conditions or metallic species such as copper under chemically oxidizing conditions. In order to further enhance the heat transfer efficiency of heating cleaning solvents by direct steam injection, mixing on the secondary side of the heat exchanger can be enhanced by gas sparging or by transferring liquid between heat exchangers when more than one heat exchanger is being cleaned at the same time.

26 Claims, 5 Drawing Sheets

(51) Int. Cl.

| | |
|---|---|
| ***B08B 9/02*** | (2006.01) |
| ***F22B 37/00*** | (2006.01) |
| ***C23G 5/00*** | (2006.01) |
| ***F22B 37/48*** | (2006.01) |
| ***F28G 9/00*** | (2006.01) |
| ***G21F 9/00*** | (2006.01) |
| ***G21F 9/28*** | (2006.01) |
| ***G21F 9/30*** | (2006.01) |

(52) U.S. Cl.
CPC *F28G 9/00* (2013.01); *G21F 9/002* (2013.01); *G21F 9/28* (2013.01); *G21F 9/30* (2013.01); *B08B 2230/01* (2013.01)

(56) References Cited

U.S. PATENT DOCUMENTS

| | | | | |
|---|---|---|---|---|
| 4,273,076 | A * | 6/1981 | Lahoda et al. | 122/382 |
| 4,492,186 | A | 1/1985 | Helm | |
| 4,581,074 | A | 4/1986 | Mankina et al. | |
| 4,652,437 | A * | 3/1987 | Nakaya et al. | 423/421 |
| 4,676,201 | A | 6/1987 | Lahoda et al. | |
| 4,706,613 | A | 11/1987 | Smith, Jr. | |
| 4,756,770 | A | 7/1988 | Weems et al. | |
| 4,899,697 | A | 2/1990 | Franklin et al. | |
| 4,971,140 | A | 11/1990 | Stoss | |
| 5,007,970 | A | 4/1991 | Herrmann et al. | |
| 5,066,137 | A * | 11/1991 | King | 366/336 |
| 5,257,296 | A * | 10/1993 | Buford et al. | 376/310 |
| 5,264,041 | A | 11/1993 | Kuhnke et al. | |
| 5,356,482 | A | 10/1994 | Mehta et al. | |
| 5,389,156 | A | 2/1995 | Mehta et al. | |
| 5,425,814 | A | 6/1995 | Krajicek et al. | |
| 5,507,306 | A * | 4/1996 | Irvine et al. | 134/166 R |
| 5,841,826 | A | 11/1998 | Rootham et al. | |
| 6,740,168 | B2 | 5/2004 | Rootham et al. | |
| 6,872,263 | B1 | 3/2005 | Jansen et al. | |
| 6,892,679 | B2 * | 5/2005 | Jameel et al. | 122/379 |
| 6,893,509 | B2 | 5/2005 | Sears et al. | |
| 6,928,937 | B2 | 8/2005 | Booher | |
| 6,936,112 | B2 | 8/2005 | Jansen et al. | |
| 7,302,917 | B2 | 12/2007 | Remark et al. | |
| 7,344,602 | B2 | 3/2008 | Varrin et al. | |
| 2004/0006841 | A1 | 1/2004 | Jameel et al. | |
| 2004/0102351 | A1 | 5/2004 | Jansen et al. | |
| 2005/0211274 | A1 | 9/2005 | Jansen et al. | |
| 2005/0247269 | A1 * | 11/2005 | Varrin et al. | 122/382 |
| 2006/0021633 | A1 * | 2/2006 | Harvey | 134/1.1 |
| 2006/0065212 | A1 | 3/2006 | Remark et al. | |
| 2006/0169305 | A1 | 8/2006 | Jansen et al. | |
| 2008/0236616 | A1 | 10/2008 | Bloch | |
| 2009/0090311 | A1 | 4/2009 | James et al. | |
| 2009/0173293 | A1 | 7/2009 | Remark et al. | |
| 2010/0313913 | A1 | 12/2010 | Hollwedel et al. | |

FOREIGN PATENT DOCUMENTS

| | | | |
|---|---|---|---|
| DE | 102008005199.3 | | 7/2009 |
| FR | 2568985 | | 2/1986 |
| FR | 2765720 | | 1/1999 |
| JP | 06-201280 | | 7/1994 |
| JP | 2005087524 | A * | 4/2005 |
| RU | 2153644 | | 7/2000 |
| UA | 64145 | | 2/2004 |
| WO | WO 02/46680 | | 6/2002 |
| WO | 2009/089991 | A2 | 7/2009 |

OTHER PUBLICATIONS

Dijoux, et al., "Application of AREVA Inhibitor-Free High Temperature Chemical Cleaning Process against blockages on SG Tube Support Plates," presented at NPC '08 Berlin, International Conference on Water Chemistry of Nuclear Reactor Systems, held in Berlin, Germany, Sep. 15-18, 2008.

Tilton, et al., "Designing gas-sparged vessels for mass transfer," Chemical Engineering, vol. 89, No. 24, Nov. 29, 1982, pp. 61-68.

Pick, "Consider direct steam injection for heating liquids," Chemical Engineering, vol. 89, No. 13, Jun. 28, 1982, pp. 87-89.

Schroyer, "Understand the Basics of Steam Injection Heating," Chemical Engineering Progress, May 1997, 4 pages.

Shah, et al., "Design Parameters Estimations for Bubble Column Reactors," AIChE Journal, vol. 28, No. 3, May 1982, pp. 353-379.

International Search Report in related application PCT/US2009/066652 mailed Feb. 4, 2010.

Office Action as issued for Chinese Patent Application No. 200980153710.5, dated Jan. 13, 2014.

* cited by examiner

FIG. 1 - Conventional Art

FIG. 3A
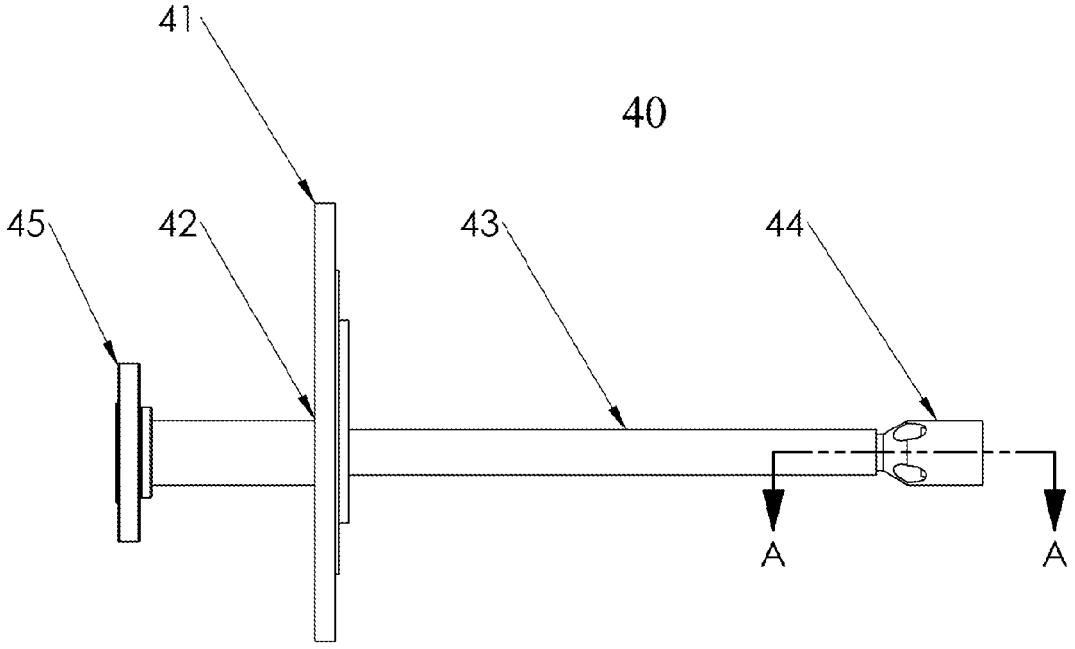
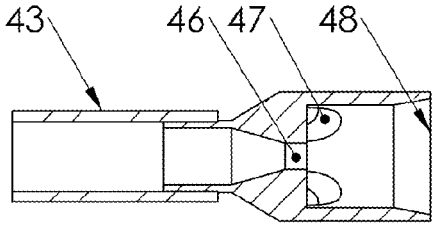
SECTION A-A
FIG. 3B

FIG. 4A
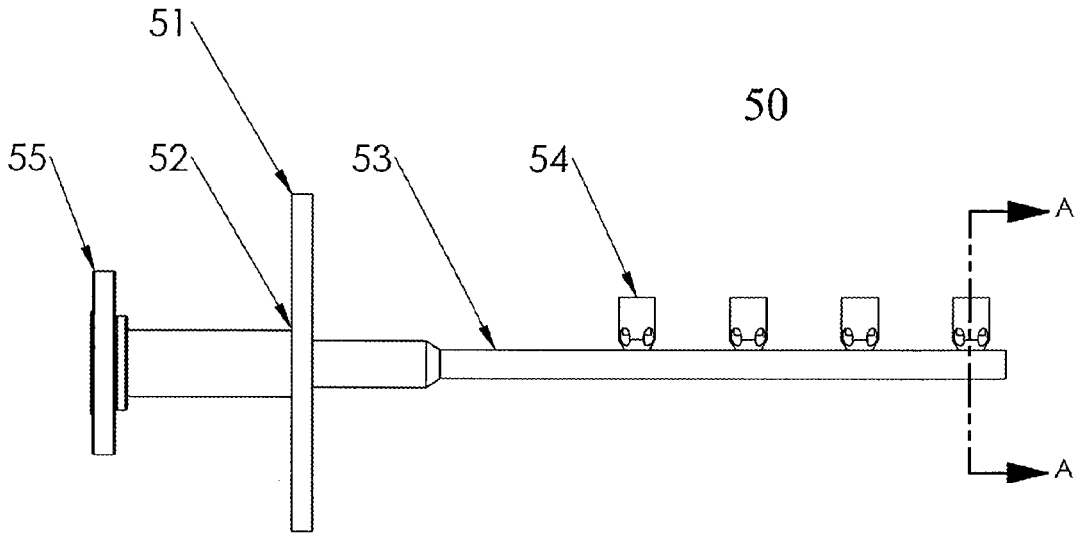
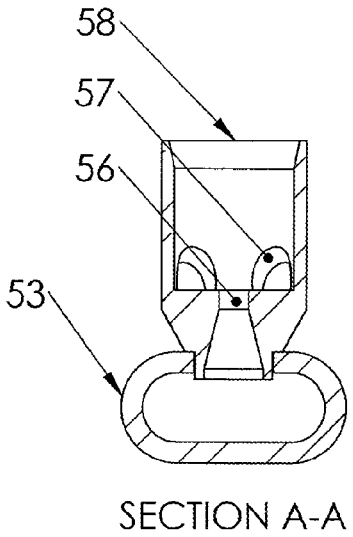
FIG. 4B

Section View

CHEMICAL CLEANING METHOD AND SYSTEM WITH STEAM INJECTION

CROSS REFERENCE TO RELATED APPLICATIONS

This is the U.S. National Phase of PCT/US2009/066652, filed Dec. 3, 2009, which claims priority to U.S. application Ser. No. 12/630,729, filed Dec. 3, 2009 and U.S. Application No. 61/119,719, filed Dec. 3, 2008, each of which are incorporated by reference herein in their entireties.

BACKGROUND

1. Field of Invention

The present invention applies to the chemical cleaning or combined chemical and mechanical cleaning of heat exchangers or vessels, including nuclear pressurized water reactor (PWR) steam generators. Example materials targeted for removal by cleaning include those that reside on the secondary (boiling) side of heat exchangers or vessels and comprise metallic oxides (e.g., magnetite), metallic species (e.g., copper), other impurities (e.g., mineral species) or waste materials. The method described herein may also be used in conjunction with other deposit or waste management strategies such as dispersants or scale conditioning agent solutions, which are added to the heat exchanger or vessel to mitigate the accumulation of deposits in these systems or to modify the structure of these deposits once accumulation has occurred. The method and system described herein may also be used with decontamination solutions or with other processes for cleaning heat exchangers or vessels, including the removal of waste, such as nuclear waste, from a vessel, heat exchanger or fluid systems where temperature control is required or helpful.

2. Description of Related Art

The removal of deposits from the secondary side of heat exchangers, and more specifically the secondary or boiling side of nuclear pressurized water reactor (PWR) steam generators, has been achieved by both chemical and mechanical means. Chemical means include high and low temperature chemical cleaning, and mechanical means include processes such as pressure-pulse cleaning, water jetting or lancing, or bundle flushes with water or chemical solutions. Chemical means and mechanical means are often combined by performing them concurrently or sequentially.

There are a variety of chemical cleaning processes used to clean heat exchangers and vessels in general, and nuclear steam generators in specific. Many of these processes are described in Frenier, W., "Technology for Chemical Cleaning of Industrial Equipment," NACE International—The Corrosion Society, 2001. As discussed below, there are two basic types of chemical cleaning processes for power plant heat exchangers and vessels such as PWR steam generators: "on-line" (plant heat) and "off-line" (external heat) cleaning processes. Off-line processes refer to processes in which the supply, heating, pumping, mixing, cooling and draining of the chemical solutions is performed via the installation and use of temporary external equipment. The equipment configurations associated with off-line processes are typically very complex, and require significant time and manpower to set up and operate. However, because the plant is fully shut down during external process applications, this type of process is often considered a preferred method of cleaning for safety, process control and other economic reasons. Off-line processes allow electrochemical corrosion monitoring equipment to be installed inside the vessel such as a steam generator to ensure that no harmful side effects of the cleaning operation are occurring. Liquid samples can also be easily taken via temporary sample lines to monitor the process and to ensure that excessive corrosion of vessel or steam generator internals does not occur during the cleaning process due to off-normal process or chemistry conditions.

Processes that use primary-to-secondary heat transfer to control the temperature of the cleaning process at a power plant such as a PWR are referred to as "plant heat" or "on-line" processes. The equipment setup and manpower requirements are significantly reduced during on-line processes because heating and cooling of the secondary side (locations of deposits) is supplied from the primary side of the plant using plant systems such as decay heat from reactor core (for heating) or the plant residual heat removal (RHR) system (for cooling). As such, no external heating or cooling equipment is required. Because plant heat processes are applied while the plant is "on-line", there is no access to the vessel such as a steam generator prior to the cleaning. This prevents the installation of corrosion monitoring equipment inside the steam generator. Liquid sampling is also more difficult during "on-line" processes because the vessel such as a steam generator may need to be partially drained back through plant systems in order to obtain a sample of the cleaning solvent. Thus, process monitoring is much more difficult during "on-line" processes. Excessive corrosion and other off-normal chemistry conditions have been known to occur during conventional "on-line" cleaning applications (see "Application of AREVA Inhibitor-Free High Temperature Chemical Cleaning Process against Blockages on SG Tube Supports," Dijoux, M. et al, presented at "NPC '08 Berlin, International Conference on Water Chemistry of Nuclear Reactor Systems," held in Berlin, Germany, Sep. 15-18, 2008).

With regard to the cleaning of nuclear steam generators, much of the original research that led to the solvents and processes used today was sponsored by the Steam Generator Owners Group (SGOG) of the Electric Power Research Institute (EPRI) and documented in several reports including EPRI-2976 entitled "Chemical Cleaning Solvent and Process Testing" (April 1983), and EPRI NP-3009 entitled "Steam Generator Chemical Cleaning Process Development" (April 1983).

Other cleaning processes which use less concentrated chemical solvents to partially remove, disrupt or change the characteristics of deposits are described in U.S. Pat. No. 5,841,826 to Rootham et al. ("Rootham I"), U.S. Pat. No. 6,740,168 to Rootham et al. ("Rootham II"), and U.S. Pat. No. 7,344,602 to Varrin et al. ("Varrin"). These processes are typically applied as on-line processes, but may be applied as offline processes based on plant-specific considerations.

In chemical cleaning processes designed for complete removal of deposits, high temperature processes generally refer to those applied, for example, at 285 to 428° F. (140 to 220° C.), see U.S. Pat. No. 5,264,041 to Kuhnke et al. ("Kuhnke"). These processes are usually applied with the temperature maintained by heat transfer from the primary side of the plant, often while the plant is shutting down for maintenance or refueling. As discussed earlier, these processes are referred to as "on-line" processes in the context of chemical cleaning. The primary side of the plant, or reactor coolant system, is the closed loop portion of the PWR plant comprising the fuel, reactor, reactor coolant pumps, the pressurizer, numerous reactor control and safety systems, and the tubes internal to the steam generators. On the other hand, the secondary side is the portion of the plant which includes the outside of the tubes in the steam generators, the steam lines, turbines, condenser, several stages of pumps, and feedwater heaters.

Low temperature processes generally refer to processes applied from, for example, 85 to 285° F. (30° C. to 140° C.), with the temperature maintained by either: (1) primary to secondary side heat transfer ("on-line"), or (2) use of temporary equipment set up outside of the containment building ("off-line"). Temporary equipment typically includes an external heating loop that exchanges heat indirectly with the main chemical cleaning process loop via an external heat exchanger (see discussion below). Heat is typically supplied to the external heating loop by a portable steam boiler, but may also be supplied by electrical heater(s) or by steam from an adjacent power plant. When steam is used, it is condensed on one side of a heat exchanger and not admixed with the cleaning solution (also referred to as indirect heating as opposed to direct steam injection).

In nuclear PWRs, the containment building houses the reactor (primary loop) and the steam generators. Steam produced on the "secondary side" of the steam generators exits the steam generators via steam lines which in turn pass through penetrations in the containment building to supply the turbine-generator. Condensed steam or "feedwater" then returns to the steam generators via separate penetrations in the containment building from the condenser through the auxiliary building which houses the aforementioned feedwater heaters, pumps and other equipment. Temporary penetrations at the containment building boundary are also available but generally limited in size and number. These penetrations are often used to connect temporary equipment to the steam generators, but the limited number and size of the penetrations makes it difficult to link or interconnect complex cleaning equipment configurations located outside of containment to the steam generators.

At PWRs, there are two basic types of steam generators (SGs). One type is known as a recirculating steam generator (RSG). In an RSG, the tubes which constitute the primary to secondary side boundary are vertically oriented and U-shaped, such that the primary coolant enters and exits the SG near the bottom. The tube "bundle" can consist of thousands of tubes. The other type of steam generator is known as a once-through steam generator (OTSG). In an OTSG, the tubes are straight and vertically oriented such the primary coolant enters at the top of the SG and exits at the bottom. In both RSGs and OTSGs, steam is produced outside the tubes. Both types of steam generators may require periodic chemical cleaning or conditioning to reduce concerns with thermal efficiency and corrosion of the tube materials.

In general, a large amount of equipment is required for off-line nuclear steam generator chemical cleaning processes that use temporary equipment for preparing, heating, cooling and recirculating chemical cleaning solvents. Requirements for the temporary cleaning equipment is well-described in Partridge, M. J. and J. A. Gorman, "Guidelines for Design of PWR Steam Generator Chemical Cleaning Systems," Electric Power Research Institute, Palo Alto, Calif., January 1983. This reference describes the methods employed for off-line "external heat" chemical cleaning of PWR steam generators using either specially designed flow loops or by a process known as "fill, soak and drain" (also described in U.S. Pat. No. 5,257,296 to Buford et al. ("Buford")) in which chemical solvents are mixed, preheated and pumped into the steam generator, allowed to soak until the temperature drops to an unacceptable level, followed by draining and reheating of the solvent external to the steam generators, and then finally re-injecting the re-heated solvent back into the steam generator. This process may be repeated multiple times until the steam generators are considered clean, at the expense of increasing overall cleaning time.

Partridge and Gorman describe the use of steam for indirectly heating of solvents (in an "external heat" process) by passing steam through a heat exchanger integral to the temporary chemical cleaning equipment system located outside of the containment building. In this configuration, steam is available from a portable boiler, but may also be supplied from an adjacent power plant.

U.S. Pat. No. 7,302,917 to Remark et al. ("Remark") discloses an on-line plant heat steam generator chemical cleaning process that involves introducing a chemical cleaning solvent to the secondary side of a steam generator and heating said solvent via heat transfer from the primary side of the plant (nuclear core decay heat and primary side recirculation pump heat) to the secondary side in "Mode 5." Mode 5 is an industry and regulatory definition describing one of six operating modes ranging from power operations (Mode 1) to shutdown and "defueled" conditions (Mode 6). Mode 5 is a condition of plant operations during which no electric power is being produced by the plant (the reactor is subcritical), but fuel remains in the core, with the primary temperature initially from 210 to 200° F. (99 to 93° C.) cooling down to less than 100° F. (38° C.).

The cleaning process disclosed by Remark is said to last for a period described as 24 to 36 hours. Typically, the PWR plant would not stop cooling the plant during a shutdown to hold the temperature at the required cleaning temperature of 200 to 210° F. (99 to 93° C.). As such, the 24 to 36 hours represents what is known as "critical path" time, or time during which electricity is not being produced. The value of electric power produced for 24 to 36 hours can be more than US$1,000,000. It is also not clear that the 24 to 36 hours includes time to inject the cleaning chemicals and partially drain the steam generators for sampling. Several of the references cited herein would suggest that 24 to 36 hours of cleaning time may be inadequate at the temperatures cited in Remark, so actual critical path impact may be greater.

The Remark specification further describes the use of nitrogen sparging at 250 to 1500 cubic feet/minute (cfm) (7.1 to 42.5 $m^3$/min) to promote mixing. The benefits of gas sparging for mixing of the fluid on the secondary side of a steam generator were studied in the 1980's (see, for example, EPRI-NP 2993 entitled "Evaluation of Steam Generator Fluid Mixing during Layup"). In this work, modeling and testing demonstrated that complete turnover of the liquid on the secondary side of an RSG could be achieved at flows from 10 to 30 cfm (0.28 to 0.85 $m^3$/min) in as little as seven minutes. The mixing time was found to predicted by Equation 1 as provided below:

$$T_{mix}=0.6\ Q^{-0.5} \tag{1}$$

Where $T_{mix}$ was the mixing time in hours, and Q was the gas flow rate in cfm. A 30 cfm (0.85 $m^3$/min) flow corresponds to a 6 minute mixing time, typically more than adequate for most chemical cleaning operations.

The rates disclosed in Remark (250 to 1500 cfm) (7.1 to 42.5 $m^3$/min) will undoubtedly promote mixing, but have the potential disadvantage of rapidly pressurizing the steam generator if a continuous vent path is not provided. The free space above the chemical cleaning solution during cleaning is on the order of 3000 to 4000 cubic feet in most RSGs. Therefore, depressurization may be required every few minutes at a gas flow rate of 1500 cfm (42.5 $m^3$/min). Depressurization would only be required every few hours at 30 cfm (0.85 $m^3$/min). Finally, high sparge rates also increase environmental emissions of volatile species such as ammonia (and other amines) and hydrazine, often present in chemical cleaning solutions.

The ability to promote mixing at low gas flows is also supported by other references such as Shah et al., "Flow Regimes in Bubble Columns," *AIChE Journal,* 28 (182), pp. 353-379, and specifically for spargers such as those used in chemical cleanings or during sparging through the blowdown pipe, as discussed in Tilton, et al., "Designing Gas-Sparged Vessels for Mass Transfer," *Chemical Engineering*, (November 1982).

Mixing of OTSGs with gas during chemical cleaning is also described in Buford (previously cited) through use of gas eductors.

A claimed advantage of the on-line process described in Remark is that it does not require that the steam generator be drained to install connections to the steam generators for the introduction, recirculation or draining of cleaning solvents. As described in Remark, off-line chemical cleaning processes usually require heating and cooling in a sequence of steps using external equipment set-up at a significant distance, up to 1500 feet (460 m) or more, from the SGs outside of the "containment building" which houses the steam generators. The distance is mandated by the need for a large "lay down" or set-up area for the external process heat equipment, and such space (typically more than 100,000 square feet) is generally not available directly adjacent to the containment building.

As described in Partridge and Gorman, numerous fluid and gas connections are made to the SGs in external heat processes. Each of these in turn requires a hose or piping to connect to the external chemical cleaning system. The external cleaning system includes a complex array of heaters, pumps, valves, storage tanks, coolers and controls. Inside of containment, there can also be literally hundreds of feet of piping, numerous pumps, and hundreds of valves. The time to set up the external process system even before the plant shutdown (after which interconnections to the steam generators are made) can range from one to three months. The time required to connect the external process system to the SGs can be an additional three to six days or more and involves up to four to twelve or more temporary adapters to be affixed to conventional access penetrations on the secondary side of the SGs. Once set up is complete, an external heat cleaning process typically requires from 5 to 10 days (144 to 240 hours) for each group or set of steam generators that are cleaned.

These adapters include supply and return lines for solvents and rinses, drains, level control instrumentation taps, pressure instrumentation taps, temperature indicator taps, gas sparging, corrosion monitoring electronics penetrations, and sample line taps. The necessity of many of these interconnections is to support external heating. The actual application time for the chemical cleaning ranges from several days to several weeks, depending on the complexity of the process (number of solvent steps, rinses, etc.). Demobilization including removing the temporary adapters from the steam generators requires several more days. Whether or not the set-up, application, and demobilization are on "critical path" depends on other plant refueling and maintenance activities that are underway. In many cases, particularly in longer refueling outages, external heat chemical cleaning processes have not affected critical path.

If heating is supplied from the primary side, as described in Remark and Kuhnke, the number of interconnections can be limited or eliminated. If no interconnections are made, other means for obtaining liquid samples and performing corrosion monitoring may be required, and these may be very difficult to implement or qualify (i.e., ensure the structural integrity and safe operation). The benefits of in situ corrosion monitoring during off-line processes (electronic corrosion monitors and coupons placed inside the SGs) is well established as reported in NP-2976 and in EPRI NP-5267 "Weld Region Corrosion During Chemical Cleaning of PWR Steam Generators" (July 1987). This is because essentially all chemical cleaning solvents will slightly corrode steam generator components including the pressure boundary shell and internal structures if fabricated from carbon and low allows steels. Typical corrosion allowances for these structures and components range from less than 0.001 to 0.010 inches (25.4 to 254 μm) for each cleaning application.

When installed inside a steam generator during a cleaning application, an in situ electrochemical corrosion monitoring system (CMS) allows for the nearly instantaneous detection of off-normal chemistry or process conditions that can lead to unacceptable corrosion. The importance of real-time corrosion monitoring is further supported by recent experience discussed in Dijoux, et al. In this reference, corrosion in some locations of one steam generator during an on-line chemical cleaning with no real-time electrochemical corrosion monitoring was reported to be 0.050 inches (1.27 mm) or five (5) times a typical corrosion allowance. The event was attributed to abnormal application conditions. The process did not use an in situ electrochemical CMS system which is considered the state-of-the-art method for corrosion monitoring during chemical cleaning. A CMS uses techniques including linear polarization resistance (LPR) and zero resistance ammetry (ZRA).

Sampling and analysis of the chemical cleaning solution as frequently as every 30 minutes is also critical to ensuring the process is proceeding as expected. Every chemical cleaning of a nuclear steam generator has included very strict requirements on chemistry of the solvents (see EPRI references cited above). As described in Partridge and Gorman, these samples can be taken from the recirculation loop or directly from sample lines on the temporary steam generator adapters during external cleaning processes. Because there is no external recirculation loop and no temporary penetrations into the steam generator during on-line/plant heat processes, partial draining of the steam generators is often required in order to sample cleaning solvents.

Based on the above, the primary advantage of on-line/plant heat processes for cleaning nuclear steam generators such as the method described in Remark is that this type of process requires a less complicated and labor-intensive equipment setup. On-line processes may also result in reduced schedule impact, although the actual impact to critical path schedule would be plant-specific (many off-line external heat chemical cleanings of nuclear steam generators have not impacted critical path). The primary disadvantage of on-line/plant heat processes is that process and corrosion monitoring may not be feasible or may be significantly more complicated, such that there is an increased potential for excessive corrosion, increased environmental impact, or other unwanted side effects. By comparison, traditional external cleaning processes are very safe in that they allow industry standard process monitoring techniques to be easily performed. However, typical equipment configurations used during external processes are complex, and require significant time and manpower to setup and operate.

A feature of the cleaning method using direct steam injection disclosed herein is that this type of process combines the advantages of on-line/plant heat and off-line/external heat processes, offering a method of external heating that results in a greatly simplified equipment setup, while at the same time allowing process monitoring equipment to be installed inside the steam generators during the cleaning. The specific advantages of the direct steam injection cleaning method, relative to traditional cleaning methods, include: (1) greatly simplified equipment configuration, including a simple method of external heating, (2) shorter set-up times and reduced manpower requirements, (3) shorter demobilization times, (4) steam generator access prior to the cleaning to facilitate installation of online corrosion monitoring equipment and coupons inside the steam generators, and (5) ability to perform liquid sampling without needing to partially drain the steam generator as described in Remark.

Previously, direct steam injection has not been used as a means for heating during cleaning of nuclear steam generators and related applications due to concerns that direct steam injection could lead to damage of vessel internals as a result of large thermal gradients or cavitation induced in the vicinity of steam injection equipment and/or vibration of steam injection equipment inside the vessel being cleaned. The direct steam injection method and apparatus disclosed herein have addressed these concerns and provide a means for introducing steam directly into nuclear steam generators or other vessels during cleaning applications with low thermal gradients in the vicinity of steam injection (e.g., below acceptable thermal gradients defined in design basis documents for nuclear steam generators or other heat exchanger equipment), and with minimal cavitation or vibration induced by steam flow, thereby preventing mechanical damage to vessel internals.

The method of cleaning with direct steam injection is applicable to conventional chemical cleaning processes as described in Frenier and the EPRI/SGOG references, as well as cleaning options such as those described in Rootham I, Rootham II and Varrin. The latter two patents describe uses of advanced "scale conditioning agents." The method described herein may also be used with dispersant or decontamination solutions, or any other processes for cleaning heat exchangers or similar vessels, or removing waste such as nuclear waste from similar vessels or fluid systems where temperature control is required or helpful.

SUMMARY

Detailed below are example embodiments of methods for removing deposits and impurities from the secondary side of a heat exchanger that will typically include the steps of removing a volume of working fluid from the secondary side of the heat exchanger sufficient to expose an access penetration; installing a temporary adapter in the exposed access penetration, the adapter being configured for direct steam injection; injecting steam through the temporary adapter and into the secondary side of the heat exchanger, wherein the injected steam heats the heat exchanger and residual fluid to a target cleaning temperature range; and maintaining the heat exchanger and the residual fluid within the cleaning target temperature range during a cleaning period. The residual fluid may include one or more of the working fluid, chemical cleaning compounds, chemical cleaning solutions, chemical cleaning solvents and water.

Some embodiments of the method may include injecting a gas into the residual fluid at a rate sufficient to induce gas sparging within the residual fluid, the gas being selected from a group consisting of steam, non-condensible gases and mixtures thereof and may be injected through an inlet provided by a vessel blowdown system and/or a temporary adapter. A cleaning solution may be formed in the heat exchanger by introducing a volume of water into the secondary side of the heat exchanger and introducing a predetermined quantity of one or more chemical cleaning reagents into the water. During the cleaning process an additional quantity of one or more chemical cleaning reagents may be introduced to maintain or improve the effectiveness of the cleaning. As will be appreciated by those skilled in the art, the composition of the cleaning solution may be altered during the cleaning period to provide, for example, rapid initial removal of deposits followed by a more controlled or gentle removal to reduce damage to the underlying structure. The volume of water introduced may be selected whereby the addition of steam condensate and the chemical cleaning reagent(s) will not exceed a predetermined secondary side volume.

Some embodiments of the method may include controlling a steam injection rate to produce a predetermined heating profile in the residual fluid, thereby reducing the likelihood of thermal shock and associated damage within the vessel being cleaned. The steam utilized for the direct injection may include saturated steam, superheated steam and mixtures thereof provided through one or more temporary adapters sequentially or in combination to achieve the desired heating performance. A controller may also be provided for controlling steam temperature and steam pressure of the injected steam to compensate for variations in liquid static head pressure range within the heat exchanger during the heating and/or cleaning period. Similarly, vents or purge valves may be provided on the heat exchanger for controlling the static head pressure within a desired range during the process.

Other embodiments of the method may include admixing one or more non-condensible gas(es) with the steam to form a combined gas stream that may then be injected into the secondary side of the heat exchanger. It is anticipated that the non-condensible gas(es) may comprise between 0.01 and 3% of the combined gas stream in such an embodiment.

As will be appreciated by those skilled in the art, a number of compositions and compounds may be utilized for cleaning the secondary side of a heat exchanger. It is anticipated that acceptable cleaning solutions may include one or more components selected from chelants, complexing agents and reducing agents, the selection being determined in part by the nature of the deposits being removed, the underlying material and the particular conditions and requirements of the heat exchanger being cleaned. Complexing agents may include, for example, EDTA, NTA, organic acids and mixtures thereof.

Also detailed below are example embodiments of systems suitable for practicing the disclosed methods for removing deposits and impurities from a secondary side of a heat exchanger. These systems will typically include a first adapter configured for temporary installation on a first conventional access penetration provided on the heat exchanger, the first adapter including a flange configured for mating to the access penetration; means for securing the adapter to the access penetration including, for example, bolts, gaskets and alignment structures; a conduit or passage for introducing or removing fluid through the access penetration; and an opening provided within the secondary side of the heat exchanger. The system will also typically include a steam source configured for connection to the conduit and a controller configured for controlling the steam injection into the secondary side of heat exchanger through the adapter. The outlet within the heat exchanger may be configured as an eductor, as multiple eductors, as a nozzle, as a regulator-type direct steam nozzle, a sparger or any other configuration or combination that provides suitable mixing of the steam and the residual liquid.

Other example embodiments may include a plurality of adapters that are arranged and configured for inducing fluid flow within the secondary side of the heat exchanger from, for example, a first adapter to a second adapter.

BRIEF DESCRIPTION OF THE DRAWINGS

Example embodiments of the method and associated apparatus are addressed more fully below with reference to the attached drawings in which:

FIG. 3A is a depiction of a steam injection adapter consisting of a single eductor and FIG. 3B is a cross-sectional view of a portion of the illustrated eductor taken along line A-A;

FIG. 4A is a depiction of a steam injection adapter consisting of more than one steam eductors and FIG. 4B is a cross-sectional view of one of the plurality illustrated eductors taken along line A-A.

Figure 1:
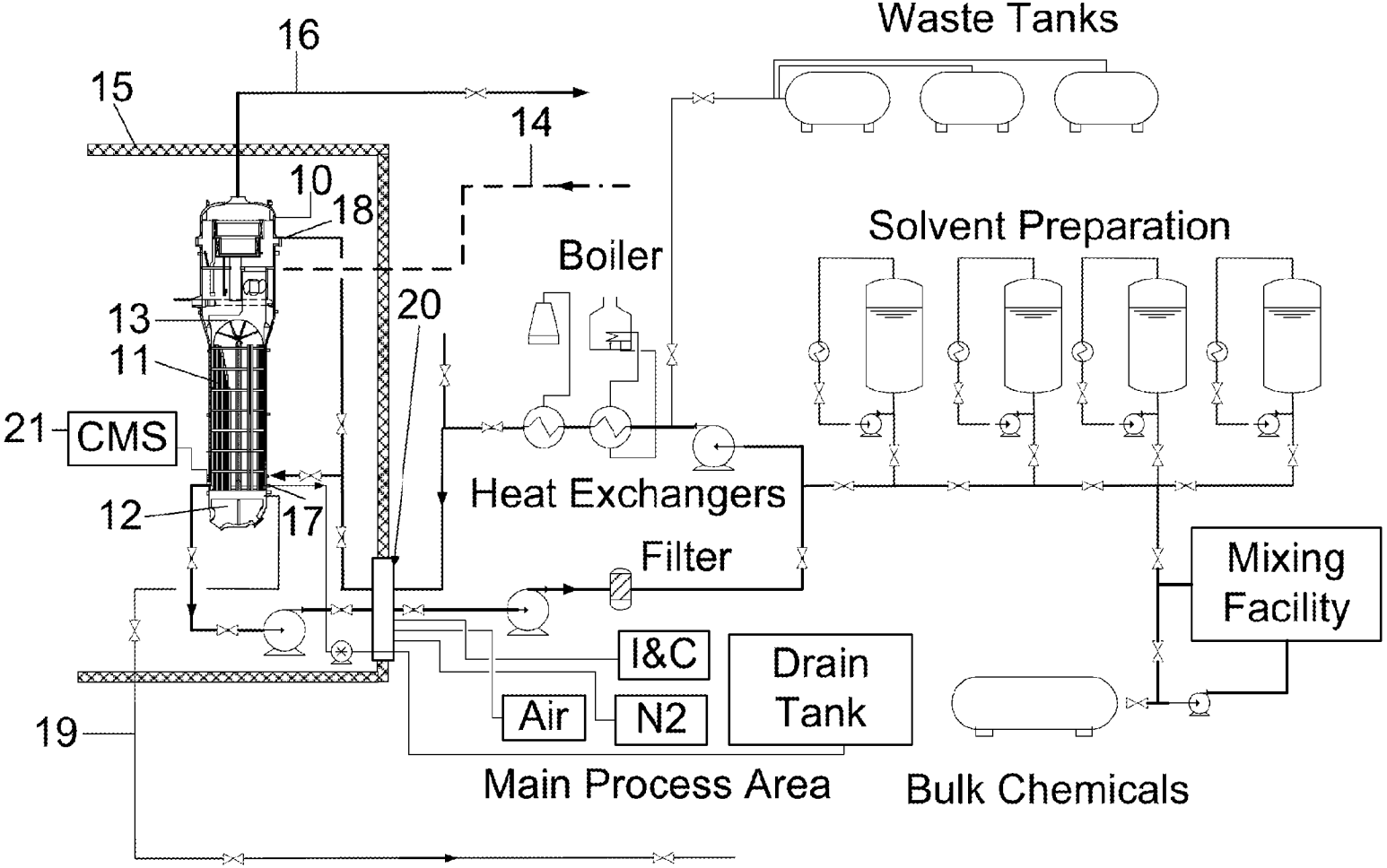
FIG. 1 is a simplified schematic illustrating a conventional configuration for an off-line/external heat cleaning of a nuclear steam generator.

It should be noted that these figures are intended to illustrate the general characteristics of methods and materials with reference to certain example embodiments of the invention and thereby supplement the detailed written description provided below. These drawings are not, however, to scale and may not precisely reflect the characteristics of any given embodiment, and should not be interpreted as defining or limiting the range of values or properties of embodiments within the scope of this invention. In particular, the relative sizing and positioning of particular elements and structures may be reduced or exaggerated for clarity. The use of similar or identical reference numbers in the various drawings is intended to indicate the presence of a similar or identical element or feature.

DESCRIPTION OF EXAMPLE EMBODIMENTS

Disclosed in more detail below are example embodiments of the method and apparatus for removing deposits and impurities from the secondary side of a heat exchanger, such as a steam generator (SG), or similarly configured vessels. An example embodiment of the method as applied to a heat exchanger typically includes the steps of taking the heat exchanger out of service, draining the working fluid from the secondary side of the heat exchanger, removing an access cover from at least one secondary side access penetration, installing a temporary adapter on the opened access penetration, the temporary adapter being arranged and configured for heating the heat exchanger system by injection of a heating fluid (e.g., steam and/or other gas) into the secondary side of the heat exchanger, initiating supply of the heating fluid before, during or after filling the heat exchanger, supplying a volume of heating fluid to the heat exchanger sufficient to heat a cleaning agent to a temperature sufficient to achieve an increased cleaning rate within the heat exchanger, terminating the heating fluid injection after the cleaning is complete, draining the cleaning agent from the heat exchanger, removing the temporary adapter(s) from the access penetration(s), installing the access cover(s) on the access penetrations and returning the heat exchanger to service.

Other embodiments of the method may include: (1) additional steps including introducing a quantity of at least one cleaning chemical reagent, in either individual or premixed form, into the working liquid (e.g., water) resident in the heat exchanger to form the liquid cleaning agent in situ, and (2) continuing to add the heating fluid continuously or intermittently during the cleaning process to compensate for energy lost by heat transfer to the surroundings.

As will be appreciated by those skilled in the art, this introduction of the cleaning chemical reagent may be made directly into the heat exchanger through one of the temporary adapters or by an "external" introduction into one or more existing lines including, for example, drain lines, feed lines and/or blowdown lines that are normally connected to the heat exchanger.

Regardless of the means of introduction utilized, the residual volume of working liquid within the heat exchanger should be adjusted or maintained at a volume that will accommodate the anticipated volume of steam condensate and chemical cleaning agents being introduced in order to avoid overfilling the heat exchanger. Monitoring of liquid volume or level may be achieved by the existing plant instrument or by temporary instrumentation. Alternatively, some form of volume and/or pressure relief may be incorporated to maintain the liquid volume and/or the pressure in the heat exchanger within target values for the duration of the cleaning operation.

Other embodiments of the method and apparatus may include controlling the flow rate of the heating fluid to achieve and maintain a target heating rate or temperature range for the heat exchanger and/or the cleaning agent(s). Depending on the control system utilized, the heating fluid flow may be substantially constant, continuous but with a variable flow rate, and/or intermittent. Example heating fluids may include, for example, superheated steam and/or saturated steam. It is anticipated that saturated steam from less than 10 psig to 250 psig (0.69 to 17 bar gauge) and/or steam superheated by up to about 100° F. (55.6° C.) would be suitable for use in practicing example embodiments of the disclosed method.

As will be appreciated by those skilled in the art, during the cleaning process, the steam temperature and pressure may be adjusted, for example, by increasing steam pressure to accommodate the liquid static head pressure in the heat exchanger as level increases, or by decreasing the steam flow rate, temperature or superheat after achieving the target temperature range.

An example apparatus for practicing the disclosed methods may include a temporary adapter configured for attachment to a conventional heat exchanger access penetration and may further include a flange that mates to the conventional access penetration, appropriate gasket(s) and fasteners for forming a fluid tight seal between the temporary adapter and the access penetration, one or more penetrations provided on the temporary adapter through which heating fluid and other materials may be supplied and/or removed from the heat exchanger, and one or more nozzles for delivering the heating fluid into the heat exchanger. As will be appreciated by those skilled in the art, the nozzle(s) may be configured in a number of ways including, for example, an eductor, a regulator-type direct steam nozzle, a sparger, or a combination thereof.

As noted above, the disclosed method provides for a number of apparatus configurations including those in which the total heating fluid nozzle area is adjustable (e.g., through valving, disc travel or other means) or those in which the heating fluid is injected into a short hose or pipe connected to one adapter on the heat exchanger and allowed to recirculate back into the steam generator through a second adapter by configuring a simple recirculation loop that can, for example, be located inside the containment vessel. The latter configuration is particularly well-suited if the heating fluid is supplied through an eductor nozzle mounted in the short recirculation line. Those skilled in the art will also appreciate that a number of constituents used in formulating the cleaning agent may be injected into the recirculation loop (e.g., one or more cleaning agents used in traditional chemical cleaning processes, a scale conditioning agent, a dispersant and/or a decontamination agent).

Other embodiments of the apparatus for practicing the disclosed method may provide for gas injection to provide additional mixing and/or to reduce the potential for cavitation or vibration of steam generator equipment. The gas or gases utilized may be injected in a substantially constant, continuous but with a variable flow rate, and/or intermittent manner. The gas may be injected with the heating fluid or through an existing plant system such as the steam generator bottom blowdown system. Nitrogen, argon, other inert gases or mixtures thereof may be used when reducing conditions are required during the cleaning. Air, oxygen, ozone, other oxidizing gases or mixtures thereof may be used when oxidizing conditions are required.

It is anticipated that for many applications a gas flow rate of 5 to 100 cfm (0.14 to 2.8 $m^3$/min) would be appropriate, and more preferably 5 to 30 cfm (0.14 to 0.84 $m^3$/mm). This target flow rate range may be corrected for system overpressure. Other embodiments may include, for example, electrochemical corrosion monitoring or periodic sampling of cleaning solutions in order to reduce the risk of damage to the vessel during the cleaning process.

It is an object of the present invention to provide a method and apparatus for cleaning of a nuclear steam generator at temperatures from 85 to 285° F. (30 to 140° C.) while the plant is offline (Mode 5 or Mode 6). The method involves allowing to plant to cool down in a conventional manner with no holds in Mode 5 until the temperature of the reactor coolant system on the primary side is less than about 40° C. The steam generator is then drained. One or more of the typically installed access penetration covers (called "hand hole" covers, "eye hole" covers, inspection port covers and the like) are removed.

The removed covers are replaced with temporary adapters wherein said adapters may be configured to permit (1) heating and maintaining the temperature of the steam generator and chemical cleaning solvents by injection of steam directly into the secondary side of the steam generator, (2) corrosion monitoring using CMS probes and coupons, (3) monitoring temperature or liquid level if other means such as typical plant instruments are not available, and/or (4) sampling the solvent to evaluate its chemical properties and the progress of the cleaning. Also, a small amount of non-condensible gas may be admixed with the injected steam to reduce the potential for steam cavitation at the nozzle and/or nozzle vibration. Steam cavitation at the nozzle is undesirable in that it may increase erosion wear of the steam injection nozzle/eductor and may also result in unacceptable noise levels during the process. As noted above, nitrogen, argon, or other inert gases may be used when reducing conditions are required during the cleaning. Air, oxygen or ozone may be used when oxidizing conditions are required. Depending on the size of the access penetration, it is possible that all of the above features could be incorporated into a single access penetration adapter. This is in contrast to the need to use up to ten (10) or more adapters for some external heat processes.

To date, direct steam injection into the steam generator has not been used for heating required during the cleaning of nuclear steam generators by conventional chemical cleaning solvents or more recently developed scale conditioning agents. However, direct steam injection is an extremely efficient technique for heating liquids as described in U.S. Pat. No. 5,066,137 to King ("King") and references such as Schroyer, J. A., "Understanding the Basics of Steam Injection Heating", *Chemical Engineering Progress*, May 1997 and Pick, "Consider Direct Steam Injection for Heating Liquids," *Chemical Engineering*, June 1982. Direct steam injection heating results in reduced energy consumption compared to typical off-line/external heat processes because there is no hot condensate return as would occur in an indirect heat exchanger heated by steam in an external heating loop.

The design of the steam injection system for a nuclear steam generator can include one of several types of injectors including a sparger or venturi eductor. (More than one injector may be used in parallel for each SG.) A "modulating" type injection system or steam mixing tee could also be used if a pump were located inside containment and forced flow from one adapter penetration through temporary piping or hoses to the steam injector penetration. This pumping arrangement is far simpler than the typical recirculation pump arrangement used to recirculate the solvents to a process equipment area often located more than 1,500 feet (457 m) from the steam generator. Hose lengths of as short as only 10 to 15 feet (3 to 4.6 m) may be required. It is even possible that such pumps could be installed inside the SG such that external hoses would not be required. If desired, real-time in situ corrosion monitors and solvent sampling directly from the steam generators are possible, either through the same adapter installed to facilitate steam injection, or through another available steam generator penetration.

Once the adapters are installed, a steam source is connected. The steam source could be a portable boiler set up outside, but close to, containment, requiring less than 400 to 500 $ft^2$ (37 to 46 $m^2$) of lay down area as opposed to 100,000 $ft^2$ (9,300 $m^2$) or more for a typical external heat process system. As an alternative to use of a portable boiler, steam from an adjacent power plant could be used. Either way, a steam line is routed from the steam source through a single containment penetration or through what is known as the equipment hatch, and attached to the adapter.

The steam line may be a flexible steam line or hard piping, but flexible steam line used in dozens of other industries and applications is preferred. Also, as an option, a gas source could be connected to the steam line to allow for pressure checks, but more importantly to provide a small concentration (a few percent) of gas comingled with the steam to suppress the potential for cavitation in the line or at the nozzle outlet. This gas may also be used to sweep residual steam out of the steam line when steam is no longer required.

Outside of containment, other connections are made to the plant systems such as the steam generator blowdown line. This line is typically a 2 inch to 4 inch (5.1 to 10.2 cm) diameter line that draws liquid from the bottom of the steam generator during normal power operations in part to prevent the buildup of soluble and insoluble impurities in a RSG. The blowdown line or pipe inside the SG is typically a perforated pipe which provides good distribution of chemicals and/or gas for sparging if the flow rate is controlled to a particular value. The connections to the blowdown line, usually in the auxiliary building or outside the plant, facilitate (1) introduction of premixed chemical cleaning solvent or concentrates, as well as for chemical makeup or replenishment during the cleaning process and (2) supply of gas for sparging to assist in mixing in the steam generator during heat up, cleaning and cool down. Rinse water may also be injected via the blowdown system or the normal plant primary or auxiliary feedwater systems. Finally, the chemical cleaning solvents may be drained to storage tanks via the connection to the blowdown system under gravity or by using the temporary chemical injection pump operating in reverse.

In one embodiment, the steam generator is first partially filled with water using either conventional plant systems (auxiliary feedwater), or via blowdown from an external water source. The initial fill level is selected so that the final (end of cleaning) fill level is reached after accumulation of: (1) the steam condensate initially injected to raise the temperature of the fluid inside the steam generator, (2) the chemical agents added to clean the steam generators, (3) the additional condensate from the steam injected to maintain the temperature of the steam generator and (4) any additional cleaning solvent injected during the cleaning application. For a typical steam generator, the final fill level is likely to be about 300 to 400 inches (7.6 to 10.2 m) above the bottom of the steam generator or "tubesheet." The final volume of liquid in such an application is typically 15,000 to 18,000 gallons (57 to 68 $m^3$). Depending on the design of the vessel to be cleaned and the nature of the cleaning solvent (e.g., EPRI/SGOG EDTA-based solvents, scale conditioning agents, decontamination agents, etc.), the initial water level may be on the order of 200 to 300 inches (5.1 to 7.6 m), and the final full volume may be different than the ranges stated above.

The steam source is then energized and steam, with or without a small percentage of non-condensible gas at up to 2% of the steam mass flow rate, is supplied directly to the steam generator. For a typical RSG filled about ⅔ with initial fill water, heating time would be on the order of four to seven hours with 125 psig saturated steam at 2,000 pounds per hour (8.6 bar at 907 kg/h). This includes heat up of the fluid as well as the steam generator structure which depending on the design may represent 100 to 230 or more tons (90.7 to 209 metric tons) of metal. Heating at a faster rate than that described above could exceed some plant "technical specification" limits, so higher steam flows may not be necessary.

In an eductor nozzle design, the pumping action of the eductor results in a jet pumping action that assists in maintaining uniformity in temperature on the secondary side of the SG. Testing has also shown that with an eductor design, the induced pumping action and admixing of the surrounding fluid with the steam within or very near the eductor results in the fluid temperatures along the eductor jet centerline beyond approximately 5 to 7 eductor outlet diameters that are typically less than 10° F. (5.6° C.) higher than that of the bulk fluid. A typical eductor outlet diameter is 2 to 5 cm. The temperature of the fluid adjacent to the eductor housing perpendicular to the jet axis is essentially at the bulk fluid temperature due to fluid entrainment with the exiting liquid jet. As a result, local heating or secondary stresses on the steam generator structures can be minimized if the nozzle/eductor is positioned in the SG such that no SG structure is closer than 5 to 7 nozzle diameters from the eductor exit. This is despite the fact that steam is being supplied at a temperature 100 to 300° F. (55 to 167° C.) higher than that of the bulk fluid. At low steam injection rates (less than about 100 to 200 pounds per hour (45.4 to 90.7 kg/hr), use of steam spargers without an eductor(s) is acceptable from the standpoint of limiting thermal gradients, vibration or cavitation concerns. However, the heating time required is greatly increased at these flow rates and the beneficial effects of the jet pumping action from an eductor are not fully realized. Note that a plurality of eductors and/or a combination eductor/sparger configuration may be used to achieve better steam dispersion and reduce cavitation/vibration, especially at elevated steam flow rates.

Gas sparging is optionally provided through a gas sparger integral to the adapter or via blowdown piping to maintain uniform chemical and temperature conditions in the steam generator. Once the desired temperature of the water is achieved, chemical cleaning agents are introduced via blowdown system with a chemical injection pump. It may also be desirable to perform steam injection in parallel with the initial fill water or chemical injection for some applications. During the cleaning process (typically 12 to 60 hours), samples of the solvent are periodically taken directly from a sample port on the adapter. There is no need to drain the steam generator to acquire samples. The results of the sample analysis are used to monitor the process per the recommendations of the previously cited references. Corrosion is also monitored in real time with an electrochemical CMS, thus minimizing the risk of unacceptable corrosion.

Upon completion of the cleaning, the solvent may be drained back through the plant blowdown system, and rinses are performed. The rinses can be applied at a temperature lower than the solvent temperature to assist in cooling.

In view of the above, the invention described herein combines advantages of on-line cleaning processes such as equipment simplicity, reduced setup time, etc. with the advantages of external heat processes such as the ability to perform corrosion monitoring and obtain liquid samples directly from the secondary side of the steam generator. These advantages can be achieved with no active equipment (pumps, valves, controls, etc.) in containment, and only one interconnection from outside containment to inside containment (the steam line) per steam generator. If it is desirable to clean two or more steam generators in parallel, separate steam lines may be provided to each steam generator. Through the example embodiment described above, it is also recognized that the direct steam injection method and apparatus disclosed herein reduce or eliminate concerns related to potential damage to internals in SGs or other vessels during cleaning applications as a result of excessive thermal gradients, cavitation, and/or vibration of steam injection equipment.

Finally, it can be recognized that heating the steam generators by direct steam injection would be equally applicable to conventional chemical cleaning solvents such as those described by Frenier (chelant, organic acid, amine and mineral acid based processes) and the EPRI/SGOG references, as well as scale conditioning agents described in several of the above-referenced patents, or any other cleaning process where temperature control is required. It is further recognized that heating the steam generators by direct steam injection can be combined with mechanical cleaning methods performed before, simultaneously with, or after the chemical cleaning.

Referring to FIG. 1, a conventional external heat chemical cleaning process is depicted. The steam generator (10) is connected to the external process system located outside of the plant using temporary adapters (17). The steam generator includes a secondary side (11), a primary side (12), and a U-tube bundle (13). The temporary adapters (17 and 18) are installed after the plant has been shut down, and the SGs drained. No connections are generally made to existing plant systems such as blowdown (19), feedwater (14), or the steam line (16). A CMS system is also installed adjacent to the steam generator (21)

Equipment in the process area outside of containment (15) can include pumps, boilers, cooling towers, control vans, heat exchangers, mix tanks, mix pumps, berms to contain spills and leaks, valves, and hundreds of other fittings and parts.

Up to six or more temporary containment penetrations (20) may be required for the external process system to interconnect with the steam generators. This includes penetrations for air to control valve positioners, nitrogen for inerting the system, and tube sheet drain lines. The typical solvent recirculation pipe sizes at the penetrations are 4 to 6 inches (10.2 to 15.2 cm) in diameter, and diameters of up to 8 inches (20.3 cm) or more may be required. Equipment in containment can include numerous hoses, pumps, piping, valves, flanges, leak prevention devices and catch basins (to contain spills and leaks). To operate the equipment depicted in FIG. 1, up to 30 personnel or more per shift are usually required.

Figure 2:
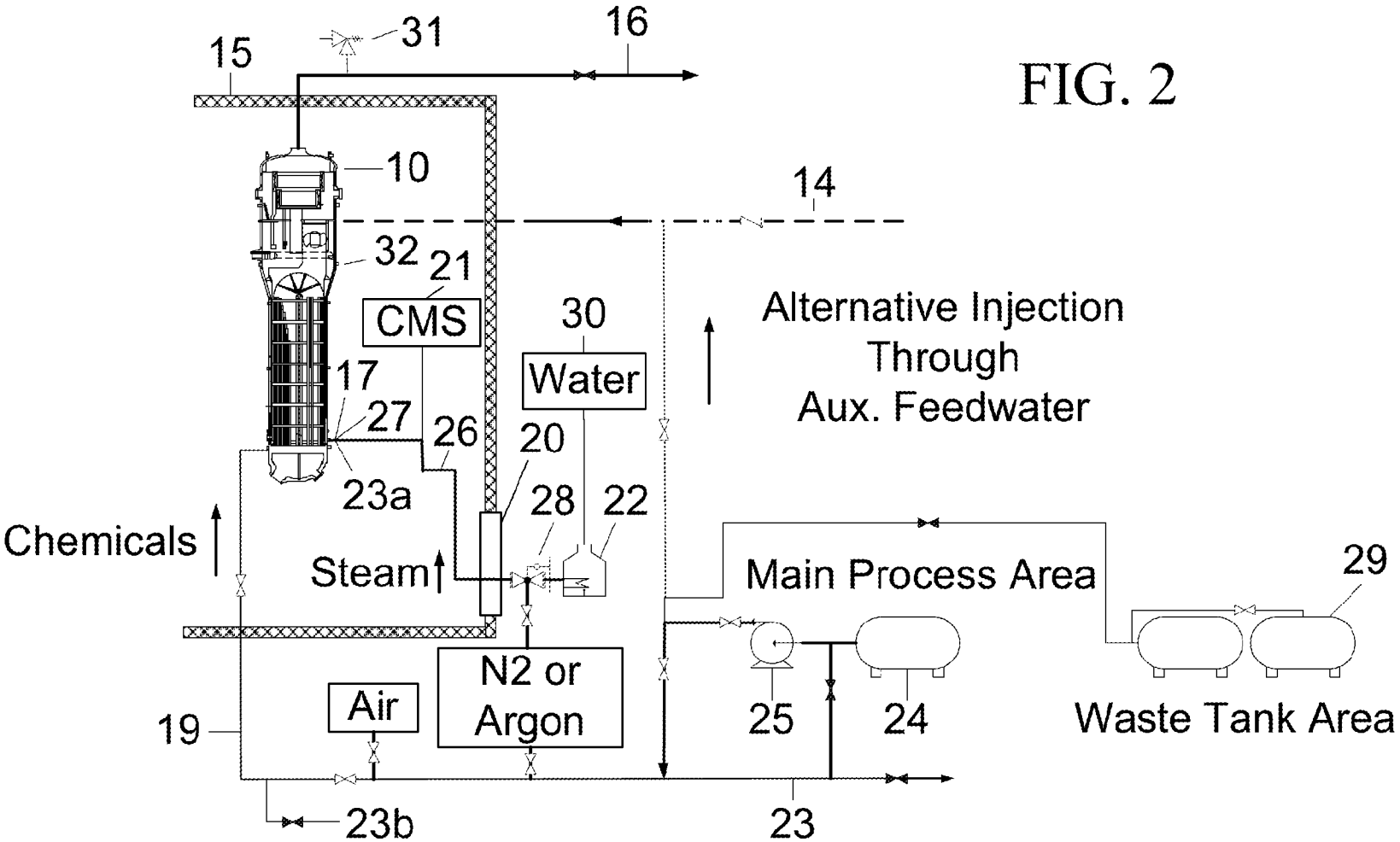
FIG. 2 is a simplified schematic illustrating an example configuration for practicing the disclosed cleaning method with direct steam injection for cleaning of a nuclear steam generator.

Referring to FIG. 2, the cleaning process with direct steam injection is depicted. The steam generator (10) is connected to a temporary steam line (26) via an SG penetration adapter (17), preferably at a 4 to 8 inch (10.2 to 20.3 cm) "hand hole penetration." The typical plant cover on this access penetration would have been previously removed after cooling the SG to about 40° C. or lower, and the steam generator having been drained using conventional plant procedures and systems. The adapter may be further configured to allow for insertion of on-line corrosion monitors (21) or other instrument such as temperature monitoring device such as a thermocouple. In the preferred embodiment, a single adapter is used, but two or more may be required if the penetrations are smaller than 4 to 8 inches (10.2 to 20.4 cm) or if components internal to the SG restrict access. Once the adapters are in place, a steam line that has been routed through containment and a single containment penetration (20) is connected to the adapter.

Referring to FIG. 3A, a single eductor temporary adapter (40) consists of a mounting flange (41) that mates to the existing vessel penetration, a penetration in the flange (42) for a rigid delivery tube (43) through which steam is supplied, a single eductor (44) and a heating fluid supply connection (45). The eductor consists of a heating fluid inlet (46), suction inlets for entraining the vessel fluid (47), and an outlet (48).

Referring to FIG. 4A, a multiple eductor temporary adapater (50) consists of a mounting flange (51) that mates to the existing vessel penetration, a penetration in the flange (52) for a rigid delivery tube (53) through which steam is supplied, multiple eductors (54) and a heating fluid supply connection (55). Each eductor consists of a heating fluid inlet (56), suction inlets for entraining the vessel fluid (57), and an outlet (58).

Figure 5:
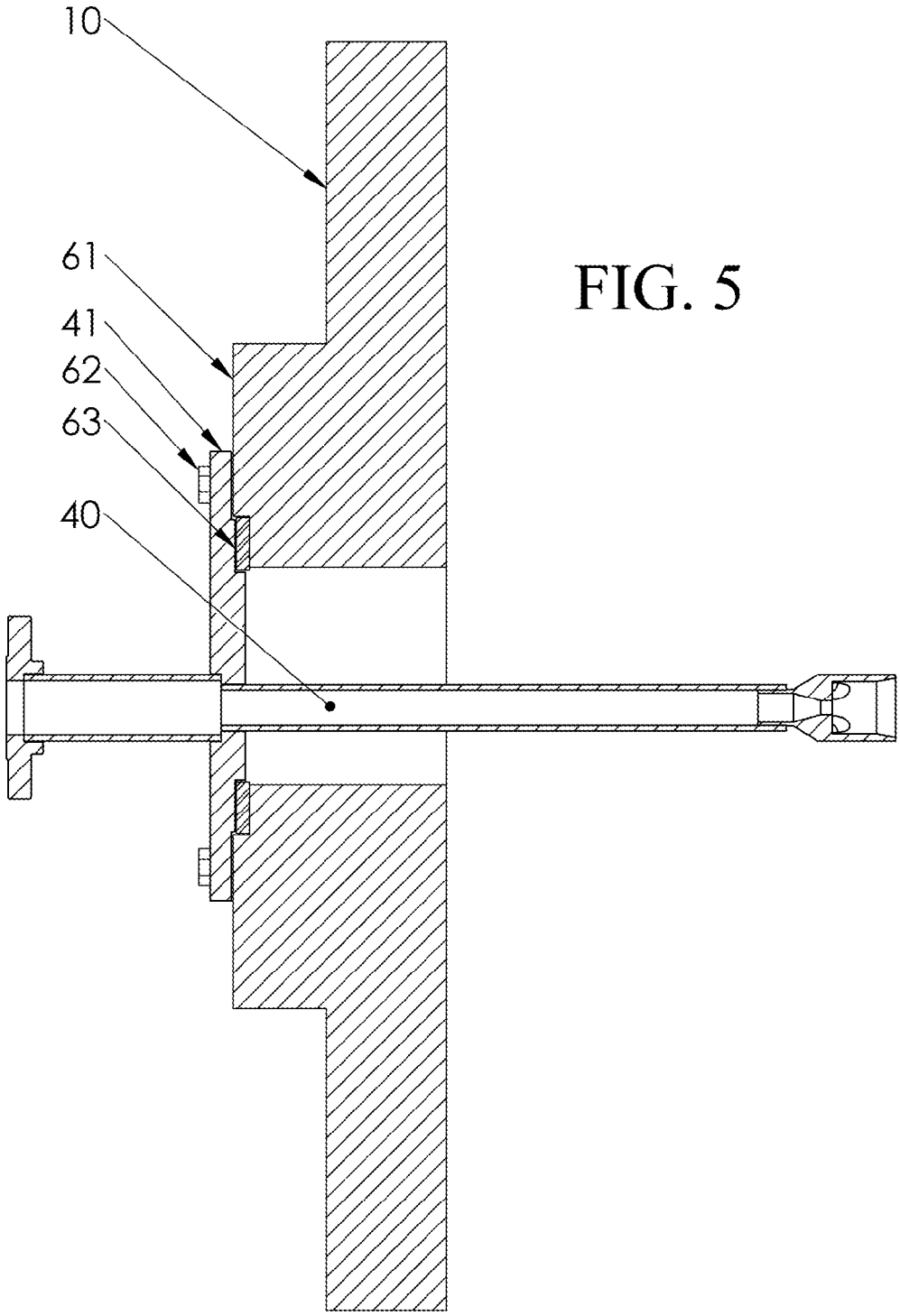
FIG. 5 depicts installation of an example temporary adapter with a single eductor in a typical nuclear steam generator.

Referring to FIG. 5, a typical installation of a single eductor temporary adapter (40) is shown. The adapter flange (41) mounts to the steam generator (10) at an existing penetration (61) using bolts (62) and a gasket for sealing (63).

In another embodiment of the invention, a modulating type direct steam injection device would be mounted as part of or adjacent to the adapter, and a pump in containment would be used to transport fluid from the steam generator to a vessel in which direct steam injection would occur. The combined stream (water or cleaning solution from the steam generator, combined with injected steam) would then be returned back to the steam generator.

In addition to the connection at the SG, connections through an existing plant system outside of the containment building, preferably in the blowdown line (19), are made for introduction of water and/or chemicals into the SG. The connection(s) also serve to allow for introduction of gas through blowdown piping to promote mixing, or establish oxidizing or reducing conditions in the steam generator as appropriate. Alternatives for introducing the water or cleaning chemicals include introduction via a connection in the plant auxiliary feedwater system, as shown in FIG. 2.

Once all connections are complete, water is introduced into the steam generator. Level during the entire process may be monitored by existing plant instrumentation or by temporary level instruments. In the preferred embodiment, this water is demineralized or other high purity water (condensate water), supplied to the SGs using plant systems and procedures, e.g. via the auxiliary feedwater system. In the preferred embodiment, the initial fill level is selected such that the final fill level after accumulation of condensed steam and the introduction of the chemical cleaning agents will be the target level for the cleaning. This is usually just over the top of the tube bundle but below critical steam generator components such as the "girth weld" (32), a weld known to be susceptible to cracking if corrosion in the form of pitting were to occur as a result of the secondary side cleaning. Overfilling the SG also results in the potential for spill over of chemical and/or foam generated during the process into plant systems such as the feedwater system through the feedwater header. Overfilling also creates more waste.

Returning again to the system illustrated in FIG. 2, once filled with water, the steam flow to the direct steam injection device is initiated. The source of steam is preferably a portable package boiler (22) but may also be a nearby power plant. Make-up water is provided to the boiler (30). The injection device affixed to the steam generator may be an eductor or sparger (27). For a fill volume of approximately 12,000 gallons (45.4 $m^3$), the time required to preheat the SG and water to say 195° F. (90° C.), a conventional application temperature for the EPRI/SGOG process described in the EPRI reference, would be approximately 6 hours based on a flow of 2000 pounds per hour (907 kg/hr) of 125 psig (8.6 bar) saturated steam (352° F. or 177° C.). One skilled in the art would recognize that this heat up time represents a small fraction of the overall cleaning time, and adds little or no time at all if the filling, heating and chemical injections were to occur simultaneously.

Note that the liquid exiting the eductor by entrainment with the steam is not at this pressure, but at a pressure equivalent to the water column head pressure in the SG. The temperature a few nozzle diameters from the eductor has been measured to be less than 10° F. (5.6° C.) above that of the bulk fluid.

In one embodiment of this invention, a small amount of non-condensible gas is also admixed with the steam at the steam supply to reduce noise/vibration and risk of any cavitation damage to the eductor device or adjacent vessel internals. Typically, the volume of non-condensible gas is less than 1%, but in some instances it could range as high as 3% or more. The overall flow of steam is controlled by a pressure regulating valve (28) external to containment.

The present method for heating the SG and the fill water is compatible with a number of cleaning chemical solvents including the EPRI/SGOG EDTA-based solvents described in the previous references. This solvent uses EDTA, hydrazine, ammonium hydroxide and a corrosion inhibitor. A concentrated formulation of this solvent (30-40% as EDTA) is then pumped from a holding tank (24), through hoses, via a pump (25) that is in turn connected to preferably the blowdown connection. The final concentration of the solvent in the SG may be from 4 to 25% as EDTA. The pumping rate is controlled so as to allow its temperature in the SG to be maintained by the steam injection. The present method is also compatible with scale conditioning agents and other amine, organic acid, mineral acid or chelating/complexing agent based deposit removal solvents for oxides or metallic species.

Mixing during or after injection of the concentrate may be enhanced by either continuous sparging with gas via the blowdown system (19), comingling the concentrate with gas during injection, or after solvent injection is complete. Mixing may also be achieved by transferring liquid between heat exchangers when more than one heat exchanger is being cleaned at the same time.

After completion of the injection of the concentrate, the SG temperature is maintained by either periodic injections of steam or by injection of steam at a reduced rate, lower pressure, or lower temperature. All of these parameters are controlled from outside containment at the boiler.

Samples of the solvent may be obtained directly from the SG without draining the boiler (22) or by temporarily stopping sparging and sampling via an exiting connection in the blowdown system (23, 23*a*, 23*b*). If required, make-up chemical constituents may be added via blowdown using the injection pump (25). Examples would include replenishing the chemical agents, or makeup of critical chemical species (e.g., corrosion inhibitor or reducing agent in the case of reductive dissolution processes). Partial draining to the waste tanks (29) can be used to accommodate the volumes of make-ups or replenishments. Note that FIG. 2 shows fewer waste tanks than FIG. 1. This is because the waste volumes are lower in this process because no recirculation system is required. The recirculation system typically accounts for 5 to 25% of the overall system volume during an external heat cleaning process. This has the advantage of reducing waste treatment costs, which for nuclear steam generator cleanings can exceed US$30 per gallon (US$8 per liter) or several million dollars per application.

As pressure in the SGs increases due to solvent off gassing (e.g., generation of nitrogen from the decomposition of some reducing agents such as hydrazine) or due to sparging, the plants steam system valves such as the atmospheric relief valves (31) could be periodically opened. This is standard procedure for chemical cleaning. However, there is a desire to limit the amount of gas discharged through these valves as the gas may contain species such as nitrogen (an asphyxiant), amines such as ammonia or morpholine (mildly toxic) and hydrazine (a carcinogen). Therefore, it is an objective of this invention to reduce the flowrate of gas used for mixing or to establish reducing or oxidizing conditions as appropriate during the cleaning process. Inert gases such as nitrogen or argon are typically used to promote reductive dissolution during cleaning processes (i.e., to remove among other species magnetite or other oxides). Air, oxygen or ozone may be used to promote oxidative dissolution (i.e., to remove metals such as copper).

Gas sparging rates via the blowdown system are set so as to promote good mixing and temperature uniformity in the SGs, while at the same time minimizing environmental emissions. The preferred range for the present invention is 5 to 100 cfm (0.15 to 2.8 $m^3$/min). Although this rate is far below that reported in some prior art, testing and analyses has shown this rate is sufficient to "turnover" the secondary side of an RSG in about 10 minutes or less. The sparging may also be continuous or intermittent. In intermittent applications, the time during which sparging is active should be a minimum of one volume turnover (e.g., 6 minutes at 30 cfm (0.85 $m^3$/min)).

From the above it should be apparent that direct steam injection for nuclear steam generator chemical cleaning results in reduced equipment complexity and personnel requirements. Another benefit of the invention is that despite the simplicity of the process and required equipment, it still allows for the installation of electrochemical corrosion monitoring equipment and coupons inside of the steam generator, and sampling of solvent without requiring draining of the steam generator. Further benefits of a simpler external heat process such as that described herein include the potential for reduced impact to critical path schedule, which is implicit in any process that delays plant cool down in Mode 5. Waste volumes are also reduced owing to the elimination of the recirculation system typically used in conventional external heat processes.

The process and equipment is applicable to conventional chemical cleaning processes, scale conditioning agents, dispersant or decontamination solutions, or any other processes for cleaning heat exchangers or similar vessels where temperature control is required or helpful. Others skilled in the art would recognize that while the preferred embodiment described herein involves injecting chemicals through the plant blowdown system, an alternative would be to inject chemicals through a steam generator adapter, via the auxiliary feedwater system, or via another appropriate access point.

We claim:

1. A method for removing deposits and impurities from the secondary side of a nuclear reactor steam generator comprising:

removing a volume of working fluid from the secondary side of the steam generator sufficient to expose an access penetration;

installing a temporary adapter in the exposed access penetration, the adapter being configured for direct steam injection while substantially sealing the access penetration from any liquid within the secondary side inadvertently leaking through the access penetration;

introducing a volume of water into the secondary side of the steam generator;

introducing a predetermined quantity of a chemical cleaning reagent into the water to form a liquid cleaning solution on the secondary side of the steam generator, the chemical cleaning reagent selected from a group consisting of chelants, complexing agents, oxidizing agents, reducing agents and mixtures thereof, wherein the liquid cleaning solution forms a substantially large bath that substantially fills open areas of the secondary side below a given elevation;

injecting steam through the temporary adapter and directly into the liquid cleaning solution in the secondary side of the steam generator to heat the steam generator and liquid cleaning solution to a target cleaning temperature range; and maintaining the steam generator and the liquid cleaning solution within the cleaning target temperature range during a cleaning period by controlling a flow rate of the injected steam.

2. The method according to claim 1, wherein the liquid cleaning solution includes a component selected from a group consisting of working fluid, chemical cleaning compounds, chemical cleaning solutions, chemical cleaning solvents, water and mixtures thereof.

3. The method according to claim 1, further comprising:

injecting a gas into the liquid cleaning solution in the secondary side of the steam generator at a rate sufficient to induce gas sparging within the liquid cleaning solution in the secondary side of the steam generator, the gas being selected from a group consisting of steam, non-condensable gases and mixtures thereof.

4. The method according to claim 3, wherein the gas is injected into the liquid cleaning solution through an inlet selected from a group consisting of a vessel blowdown system and the temporary adapter.

5. The method according to claim 1, further comprising: introducing an additional quantity of the chemical cleaning reagent during the cleaning period.

6. The method according to claim 1, wherein the volume of water introduced is selected whereby the addition of steam condensate and the chemical cleaning reagent will not exceed a predetermined secondary side volume.

7. The method according to claim 1, further comprising: controlling a steam injection rate to produce a predetermined heating profile in the cleaning solution.

8. The method according to claim 1, wherein the steam is selected from a group consisting of saturated steam, superheated steam and mixtures thereof.

9. The method according to claim 1, further comprising: controlling steam temperature and steam pressure of the injected steam to compensate for variations in liquid static head pressure range within the steam generator during the cleaning period.

10. The method according to claim 1, wherein the complexing agent is selected from a group consisting of EDTA, NTA, organic acids and mixtures thereof.

11. The method according to claim 1, wherein the steam is injected at a rate greater than 200 pounds per hour.

12. The method according to claim 11, wherein the steam is injected at a rate greater than 1000 pounds per hour.

13. The method according to claim 12, wherein the steam is injected at a rate of about 2000 pounds per hour.

14. The method of claim 1, wherein the access penetration is disposed lower than a level of the liquid cleaning solution in the secondary side of the steam generator during the injecting of the steam.

15. A method for removing deposits and impurities from the secondary side of a nuclear reactor steam generator comprising:

removing a volume of working fluid from the secondary side of the steam generator sufficient to expose an access penetration;

installing a temporary adapter in the exposed access penetration, the adapter being configured for direct steam injection while substantially sealing the access penetration from any liquid within the secondary side inadvertently leaking through the access penetration;

admixing a gas with steam to form a combined gas stream for injection into the secondary side of the steam generator;

injecting the combined gas stream through the temporary adapter and directly into a volume of liquid in the secondary side of the steam generator, wherein the injected steam heats the heat exchanger and volume of liquid to a target cleaning temperature range; and maintaining the steam generator and the volume of liquid within the cleaning target temperature range during a cleaning period by controlling a flow rate of the injected steam, wherein the volume of liquid forms a substantially large bath that substantially fills open areas of the secondary side below a given elevation and said gas that is admixed with the steam does not condense during the cleaning period.

16. The method according to claim 15, wherein the gas comprises between 0.01 and 3% of the combined gas stream.

17. The method according to claim 15, wherein the gas includes nitrogen, argon, or mixtures thereof, or air, oxygen, ozone or mixtures thereof.

18. The method according to claim 15, wherein the volume of liquid includes a chemical cleaning reagent selected from a group consisting of chelants, complexing agents, oxidizing agents, reducing agents and mixtures thereof.

19. The method according to claim 15, wherein the gas reduces the potential for the injected steam to cause cavitation damage within the steam generator during the cleaning period.

20. The method of claim 15, wherein the access penetration is disposed lower than a level of the volume of liquid in the secondary side of the steam generator during the injecting of the combined gas stream.

21. A method for removing deposits and impurities from the secondary side of a nuclear reactor steam generator comprising:

removing a volume of working fluid from the secondary side of the steam generator sufficient to expose an access penetration;

installing a temporary adapter in the exposed access penetration, the adapter being configured for direct steam injection while substantially sealing the access penetration from any liquid within the secondary side inadvertently leaking through the access penetration;

admixing a gas with the steam to form a combined gas stream comprising the gas and the steam;

injecting the combined gas stream through the temporary adapter and directly into a volume of liquid in the secondary side of the steam generator, wherein the injected steam heats the steam generator and the volume of liquid to a target cleaning temperature range; and maintaining the steam generator and the volume of liquid within the cleaning target temperature range during a cleaning period by controlling a flow rate of the injected steam, wherein the volume of liquid forms a substantially large bath that substantially fills open areas of the secondary side below a given elevation and the gas in the combined gas stream reduces a potential for the injected steam to cause cavitation damage in the steam generator during the cleaning period.

22. The method of claim 21, wherein the access penetration is disposed lower than a level of the volume of liquid in the secondary side of the steam generator during the injecting of the combined gas stream.

23. A method for removing deposits and impurities from the secondary side of a steam generator of a nuclear pressurized water reactor, the method comprising:

removing a volume of working fluid from the secondary side of the steam generator sufficient to expose an access penetration;

installing a temporary adapter in the exposed access penetration, the adapter being configured for direct steam injection while substantially sealing the access penetration from any liquid within the secondary side inadvertently leaking through the access penetration and including a flange configured for mating to the access penetration;

a conduit for introducing or removing fluid through the access penetration; and an opening provided within the secondary side of the steam generator, wherein said conduit is in communication with a steam source configured to supply steam and a gas source configured to supply a gas;

introducing a volume of water into the secondary side of the steam generator; introducing a predetermined quantity of a chemical cleaning reagent into the water to form a liquid cleaning solution on the secondary side of the steam generator, wherein the chemical cleaning reagent is selected from a group consisting of chelants, complexing agents, oxidizing agents, reducing agents and mixtures thereof, wherein the liquid cleaning solution forms a substantially large bath that substantially fills open areas of the secondary side below a given elevation;

admixing the gas with the steam to form a combined gas stream for injection into the secondary side of the steam generator, wherein the gas comprises between 0.01 and 3% of the combined gas stream and does not condense during a cleaning period;

injecting the combined gas stream through the temporary adapter and directly into the liquid cleaning solution in the secondary side of the steam generator, wherein the injected steam heats the steam generator and cleaning solution to a target cleaning temperature range, and wherein the steam is injected at a rate greater than 200 pounds per hour; and maintaining the steam generator and the cleaning solution within the cleaning target temperature range during the cleaning period by controlling a flow rate of the injected steam, wherein a temperature and a pressure of the injected steam is controlled to compensate for variations in liquid static head pressure range within the steam generator during the cleaning period, wherein the gas in the combined gas stream reduces a potential for the injected steam to cause cavitation damage in the steam generator during the cleaning period.

24. The method according to claim 23, wherein the steam is injected at a rate greater than 1000 pounds per hour.

25. The method according to claim 24, wherein the steam is injected at a rate of about 2000 pounds per hour.

26. The method according to claim 23, wherein the gas includes nitrogen, argon, or mixtures thereof, or air, oxygen, ozone or mixtures thereof.

* * * * *